United States Patent [19]

Stackhouse

[11] Patent Number: 4,513,851

[45] Date of Patent: Apr. 30, 1985

[54] COIN COUNTING AND RELEASE MECHANISM

[75] Inventor: Wells F. Stackhouse, Leesburg, Fla.

[73] Assignee: American Locker Security Systems, Inc., Jamestown, N.Y.

[21] Appl. No.: 524,537

[22] Filed: Aug. 19, 1983

[51] Int. Cl.[3] ..... G07F 5/04

[52] U.S. Cl. ..... 194/51; 194/1 G

[58] Field of Search ..... 194/59, 51, 65, DIG. 2, 194/1 G, 1 H, 52, 92, 18, 19, 37, 54

[56] References Cited

U.S. PATENT DOCUMENTS

| | | | |
|---|---|---|---|
| 948,838 | 2/1910 | Asbury | 194/DIG. 2 |
| 2,957,568 | 10/1960 | Gabrielsen | 194/18 |
| 2,996,163 | 8/1961 | Baker, Jr. | 194/37 |
| 3,050,169 | 8/1962 | Stackhouse | 194/19 |
| 3,193,074 | 7/1965 | Stackhouse | 194/92 |
| 3,228,506 | 1/1966 | Stackhouse | 194/92 |
| 3,599,770 | 8/1971 | Stackhouse | 194/92 |
| 3,773,158 | 11/1973 | Wada | 194/32 |
| 3,917,046 | 11/1975 | Yorisue et al. | 194/9 |
| 3,938,640 | 2/1976 | Stackhouse | 194/92 |
| 4,072,223 | 2/1978 | Kinoshita et al. | 194/54 |
| 4,131,191 | 12/1978 | Barth et al. | 194/92 |
| 4,153,150 | 5/1979 | Barth et al. | 194/92 |
| 4,384,641 | 5/1983 | Stackhouse | 194/92 |

*Primary Examiner*—Stanley H. Tollberg

*Attorney, Agent, or Firm*—Bean, Kauffman & Bean

[57] ABSTRACT

A coin counting and release mechanism is disclosed for use in adapting coin operated lock units for multiple coin operation, wherein only a last deposited coin of a preselected number of coins of a given size or denomination is actually retained within the lock unit for sensing purposes and all previously deposited coins of such size or of a smaller size being permitted to pass freely downwardly through the lock unit in order to avoid the possibility of an improper coin sensing operation or jamming of the lock unit as a result of insertion of improperly sized coins. In an alternative construction the mechanism is adjustable to selectively vary the preselected number of coins required for operation of a lock unit.

18 Claims, 9 Drawing Figures

Fig. 1.
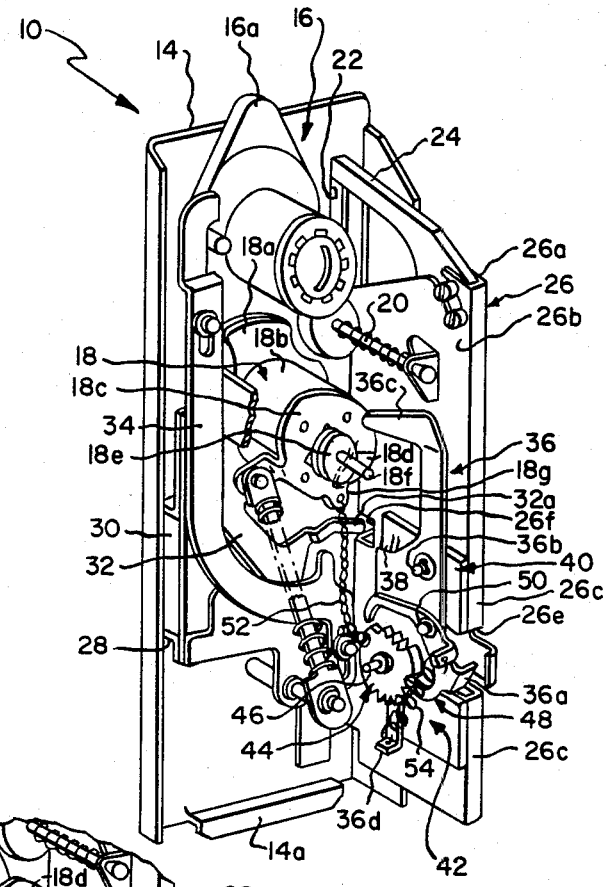
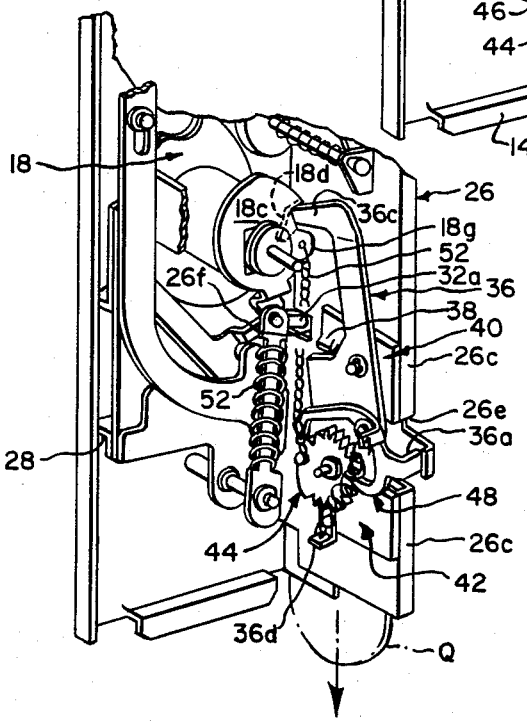
Fig. 2.

COIN COUNTING AND RELEASE MECHANISM

BACKGROUND OF THE INVENTION

In prior commercial coin operated lock units of the type described for example in U.S. Pat. Nos. 3,228,506 and 3,599,770, a coin gauging lever is supported on a side wall of the coin chute for pivotal movements between coin gauging and release positions. When in gauging position, the lever cooperates with a front edge of a coin chute or other suitably defined gauging surface to gauge the size of coins deposited in the coin chute and to temporarily support a properly sized coin in a coin sensing position or station, wherein it can be sensed by a coin feeler finger, which thereupon frees a patron key controlled lock for rotation from its unlocked into its locked position. Rotation of the patron lock into its locked position or subsequent removal of the patron key from the patron lock frees the coin gauging lever for pivotal movement into a release position permitting the previously sensed coin to fall by gravity for discharge from the lock unit; the lever thereafter being forced to return to its gauging position as an incident to the return of the patron lock to its unlocked position or reinsertion of the patron key.

A decided drawback of these prior lock units is that they are limited in use to operation by a single coin.

Various attempts described for instance in U.S. Pat. Nos. 3,938,640; 4,131,191; 4,153,150 and 4,423,805 have been made to adapt or retrofit previously installed lock units of the type described in U.S. Pat. Nos. 3,338,506 and 3,599,770 for operation of two or more coins, but such attempts have met with only limited success.

SUMMARY OF THE INVENTION

The present invention is directed to an improved coin counting and release mechanism equally adapted for use in new lock units and in retrofitting of previously installed lock units of the type described in U.S. Pat. Nos. 3,228,506 and 3,599,770 to provide for a substantial increase in the coin operating capacity of such units without degradation in coin gauging capacity.

The present invention contemplates the provision of mechanisms, which can be directly substituted for a coin gauging lever of a conventional lock unit of the type described for purposes of changing such unit from a single coin to a multiple coin operation.

The mechanism may be provided with a preset operating capacity, as for example a seven quarter capacity, or be made adjustable to permit a custodian to vary the operating capacity between desired minimum and maximum limits.

A further advantage of the present mechanism lies in that only a last deposited coin of a preselected number of coins of a given size or denomination is actually retained within the lock unit for sensing purposes; all previously deposited coins of such size or of smaller size having been permitted to pass freely downwardly through the lock unit so as to avoid the possibility of an improper coin sensing operation or jamming of the lock unit resulting from insertion thereinto of improperly sized coins.

DRAWINGS

The nature and mode of operation of the present invention will now be more fully described in the following detailed description taken with the accompanying drawings wherein:

FIG. 1 is a a rear perspective view of a lock unit incorporating a coin counting and release mechanism of the present invention depicted in its normal unlocked condition;

FIG. 2 is a partial view similar to FIG. 1, but showing the lock unit in its locked condition;

Figure 4:
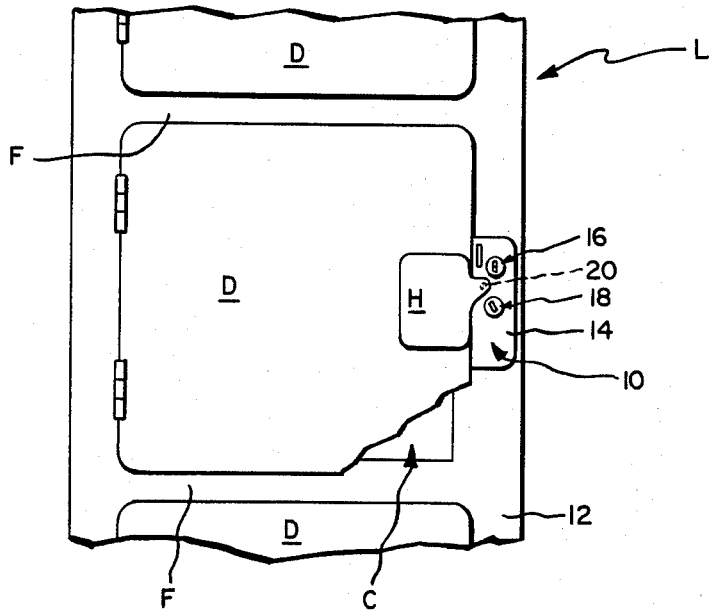
Fig. 4. PRIOR ART
Figure 5:
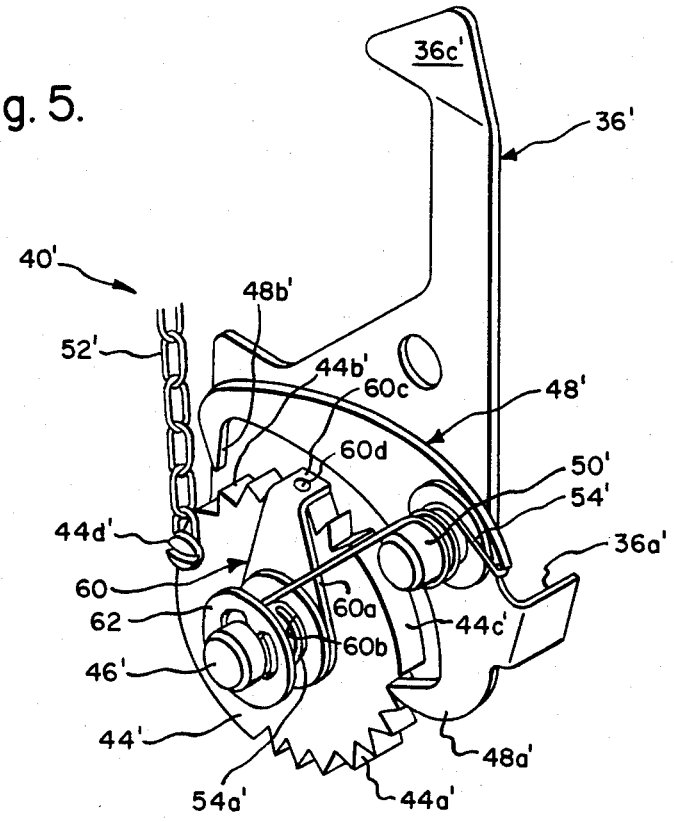

FIGS. 3*a*–3*e* are side elevational views of the present mechanism showing successive steps in the operation thereof;

FIG. 4 is a front elevational view of a conventional coin operated locker cabinet; and FIG. 5 is a perspective view of an alternative form of the present mechanism.

DETAILED DESCRIPTION

Reference is first made to FIG. 1, wherein a lock unit formed in accordance with the present invention is generally designated as 10, and to FIG. 4, wherein lock unit 10 is shown as being mounted within the frame of a typical coin operated locker cabinet designated as "L". Cabinet "L" may include one or more upright lock unit mounting posts 12, which cooperate with each other and/or a hinge mounting post 12*a* to horizontally bound one or more columns of storage compartments "C", wherein the compartments of each column are vertically separated by horizontal frame members "F" extending between such posts. The forwardly facing access openings of the storage compartments are selectively closed by suitable doors "D", which are hingedly secured to the hinge mounting posts or to intermediate ones of the lock unit mounting posts for instances where the locker cabinet is provided with more than one column of storage compartments, and selectively and releasably secured in locked or storage compartment closed condition by associated ones of lock units 10. Each door "D" is provided with a handle "H" for use in moving same between storage compartment open and closed condition and for use in freeing lock unit 10 for door locking purposes.

Lock unit 10 is similar in construction to lock units disclosed in U.S. Pat. Nos. 3,193,074; 3,228,506 and 3,599,770 whose disclosures are specifically incorporated by reference herein. However, to facilitate description of the present invention and understanding of the difference between same and these prior lock units, lock unit 10 will be generally described as including a front or mounting plate 14, which is provided with apertures, not shown, to receive the forwardly projecting ends of a key operated custodian lock 16, a key operated patron lock 18 and a patron lock release rod 20 and with an aperture 22 serving to define a coin insertion slot whose effective size may be reduced by a blocking plate 24 to prevent insertion into the lock unit of coins exceeding the diameter of a given coin, such as a U.S. quarter, intended for use in operating the lock unit.

Front plate 14 additionally serves to mount a vertically extending open ended coin chute 26, whose upper end is arranged in communication with coin insertion slot 22; a bracket 28, which serves to slidably support a lock bolt 30 for reciprocating movement between its retracted or unlocked position shown in FIG. 1 and an extended or locked position, not shown, incident to movement of patron lock 18 between its unlocked and locked conditions shown in FIGS. 1 and 2, respectively; a spring biased, pivotally supported pawl 32 having a coin feeling or sensing finger 32*a;* and a control plate 34. Lock unit 10 may be releasably retained within a mounting opening, not shown, provided in mounting post 12, by a bottom lip 14*a* formed integrally with front plate 14 and a latch plate 16*a* carried by custodian lock 16.

Coin chute 26 is shown as being defined by a generally U-shaped bracket having outer and inner plate portions 26*a* and 26*b* and a rear or connecting flange portion 26*c*. Plate portions 26*a* and 26*b* are arranged in parallel relationship and spaced one from another to insure that coins inserted through aperture 22 pass downwardly on edge through the coin chute; rear flange portion 26*c* and a front flange portion 26*d* formed integrally with inner plate portion 26*b* serving to define the rear and front edges of such coin chute. Inner side plate portion 26*b* and flange portions 26*c* and 26*d* are cut away to define openings 26*e* and 26*f* affording access to the interior of coin chute 26 adjacent its rear and front edges, respectively.

In prior lock unit constructions of the type thus far described, an upper latching end, not shown, of spring biased pawl 32 is arranged for cooperation with a latching tooth, also not shown, which is defined by a radially extending rim or disc 18*a* carried for rotation with patron lock barrel 18*b*, for purposes of normally constraining the patron lock barrel from rotation under the control of a patron key between its unlocked and locked positions shown in FIGS. 1 and 2, respectively, until such time as a coin having some given or predetermined diameter is supported at a sensing station arranged intermediate the upper and lower ends of coin chute 26 in alignment with access opening 26*f*. The arrangement is such that upon manipulation of the patron lock operating key to initiate rotation of patron lock barrel 18*b* towards its locked position, the spring bias applied to pawl 32 acts to thrust finger 32*a* through opening 26*f* to determine whether or not a coin is positioned in the sensing station. If a coin is so positioned, the inserted end of finger 32*a* abuts against such coin and thereby serves to prevent engagement of the latching end of pawl 32 with the latching tooth associated with rim 18*a* in order to free patron lock barrel 18*b* for continued rotation into its locked position.

Further, in such prior lock units, a coin is releasably retained at the sensing station by cooperation of a stationary gauging surface, such as that defined by the inwardly facing surface 26*d'* of coin chute flange 26*d*, and a coin gauging/retaining lever, which is similar to lever 36 depicted in the drawings in that it serves to carry a gauging element or coin intercepting finger 36*a* arranged to project into coin chute 26 through opening 26*e* and is in turn pivotally supported on the coin chute by a mounting pin 36*b* for movement under the control of patron lock 18 between coin gauging and release positions comparable to those of lever 36 depicted in FIGS. 1 and 2, respectively. Further, as in the case of certain of these prior lock constructions, lever 36 may be operably coupled to or be placed under the control of patron lock 18 for forming its upper end to define a follower finger 36*c* arranged to slidably engage with a patron lock barrel affixed plate 18*c* having a forwardly inclined cam or release surface 18*d;* the planar rear surface of plate 18*c* cooperating with a coin chute mounted stop 38 to normally retain the lever in its coin gauging position shown in FIGS. 1, 3*a* and 3*d*, and cam surface 18*d* permitting counterclockwise directed pivotal movements of the lever into release position shown in FIGS. 2 and 3*e*, as a result of the weight of the previously sensed coin acting against gauging element 36*a*. Alternatively, lever 36 may be otherwise coupled to or be placed under the control of patron lock 18, as for instance by replacing finger 36*c* with a spring device, not shown, which is arranged to engage a patron key ejection pin 18*f* slidably supported by patron lock barrel 18*e* with its forward end arranged to engage with the inserted end of the patron key; such construction being characterized in that the lever spring device acts through pin 18*f* to automatically eject the patron key upon placement of the patron lock in its locked condition and in that the forwardly directed ejecting movement of the pin permits pivotal movement of the lever into its release position. A more detailed description of these alternative modes of coupling the lever to the patron lock may be had by referring to U.S. Pat. No. 3,599,770.

In accordance with the present invention, the coin gauging/retaining lever of the above described prior lock units is replaced by a coin counting and release mechanism generally designated as 40 for purposes of permitting such prior lock units to be converted from single coin to multiple coin operation. Mechanism 40 generally comprises lever 36, which has been described in part above; a coin gauging and counting means 42 defined by a coin counting means in the form of a wheel 44 rotatably supported on the lever by a bearing pin 46 and a coin gauging means in the form of a ratchet pawl 48 pivotally supported on the lever by pivot pin 50; and suitable mechanism reset means, such as may be defined by a flexible tension member in the form of a link chain 52.

Wheel 44 is shaped to define first and second groups of ratchet teeth 44*a* and 44*b*, which extend radially of the rotational axis of the wheel and are annularly separated by stop means defined for example by a stop surface 44*c*. Wheel 44 is fitted with suitable means, such as a threaded fastener 44*d* for connection to one end of reset chain 52 whose opposite end is link connected to an apertured ear 18*g* formed integrally with plate 18*c*. Further, wheel 44 is considered to have a first rotatable position shown in FIGS. 3*a* and 3*e*, which is defined by the connection between the wheel and patron lock 18 afforded by reset chain 52; and a second rotatable position shown in FIG. 3*d*, which is defined by the placement of stop surface 44*c*.

Ratchet pawl 48 is shaped to define first and second tooth elements 48*a* and 48*b*, which are arranged to cooperate with ratchet teeth 44*a* and 44*b*, respectively; the above mentioned coin intercepting finger or gauging element 36*a;* and an apertured ear 48*c* for connection to a coil spring 54 whose opposite end is connected to an apertured ear 36*d* formed integrally with lever 36. Spring 54 provides a bias tending to maintain ratchet pawl 48 in a first pivotal position best shown in FIGS. 3*a*, 3*c* and 3*e*, wherein first tooth element 44*a* engages and second tooth element 48*b* is removed from engagement with ratchet teeth 44*a* and 44*b*, respectively, while permitting pivotal movement thereof into a second pivotal position shown in FIG. 3*b*, wherein first tooth element 48*a* is removed from engagement and second tooth element 48*b* engages ratchet teeth 44*a* and 44*b*, respectively. It will be noted by referring to FIGS. 3*a*, 3*b* and 3*c* that movement of ratchet pawl 48 from its first pivotal position into its second pivotal position against the bias of spring 54 and the subsequent return of the ratchet pawl from its second pivotal position to its first pivotal position under such bias completes a single coin counting cycle of pivotal movement of the ratchet pawl, during which in succession second tooth element 48*b* engages with one of ratchet teeth 44*b* and tooth element 48*a* engages with one of ratchet teeth 44*a* to drive wheel 44 in a stepwise manner through a single coin counting cycle of rotational movement in a counterclockwise direction, as viewed in these figures, towards the second rotatable position of the wheel shown in FIG. 3*d*.

Figure 3A:
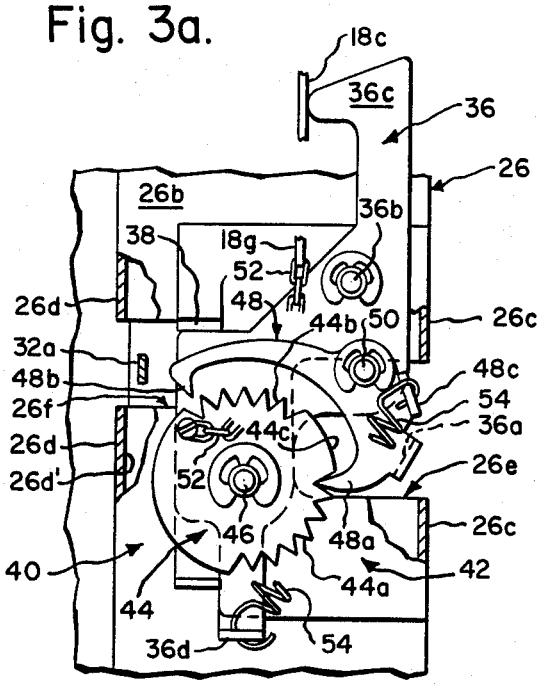
Figure 3B:
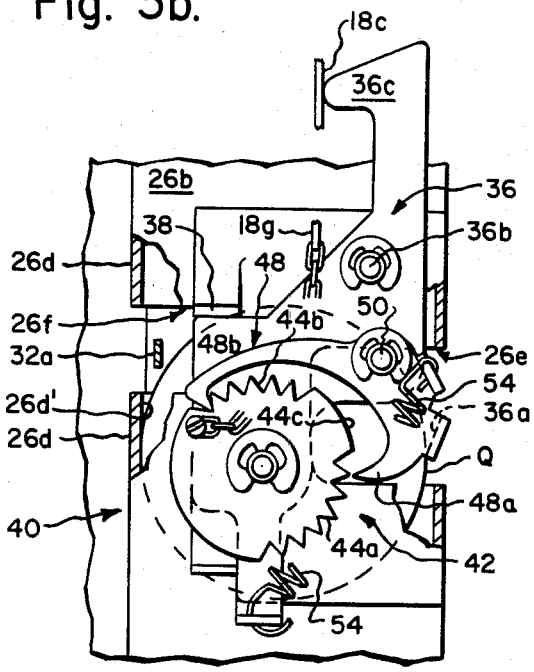
Figure 3C:
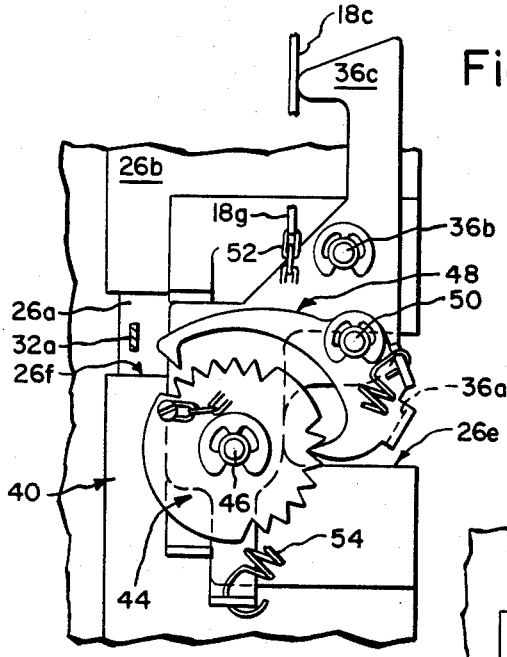

When lever 36 is in its coin gauging position and ratchet pawl 48 is in its first pivotal position, as shown in FIGS. 3*a* and 3*c*, gauging element 36*a* is disposed in its gauging position, wherein it is spaced from gauging surface 26*d'* through a distance, which is less than a given or predetermined maximum diameter of a coin, such as a U.S. quarter "Q", intended for use in operating lock unit 10, but greater than the diameter of smaller coins of like currency, such as U.S. dimes, nickels and pennies. On the other hand, when ratchet pawl 48 is in its second pivotal position with lever 36 remaining in its coin gauging position, as shown in FIG. 3*b*, gauging element 36*a* is in its release position, wherein it is spaced from gauging surface 26*d'* through a distance which exceeds the given coin diameter, so as to permit unobstructed passage of coins of such given diameter downwardly through coin chute 26.

Figure 3D:
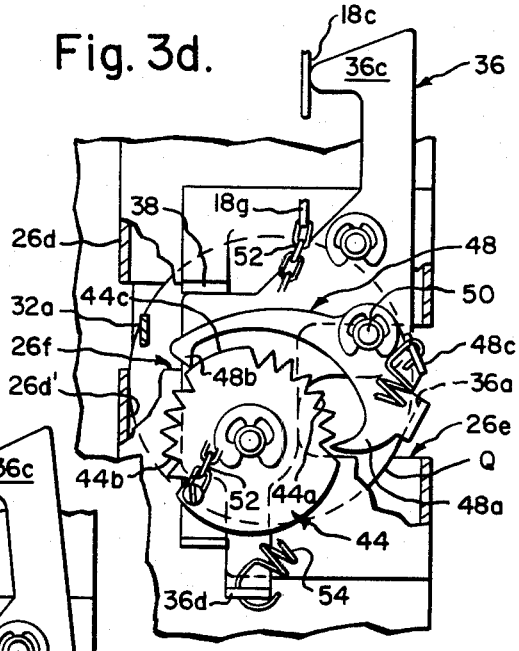
Figure 3E:
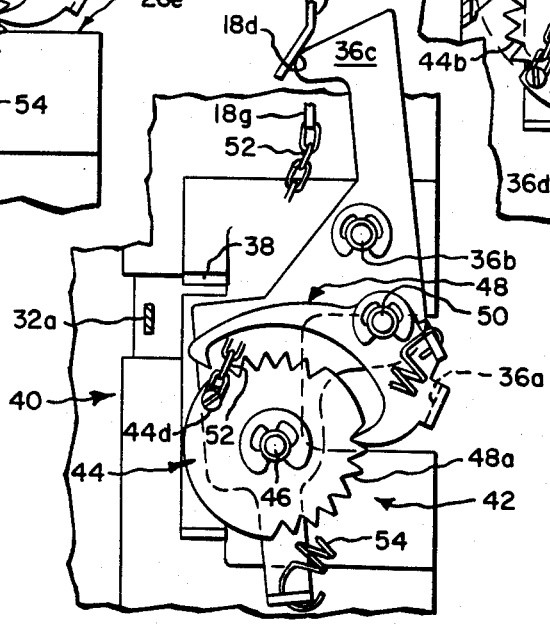

By now viewing FIG. 3*d*, it will be noted that ratchet pawl 48 may be arrested during movement towards its second pivotal position upon movement of wheel 44 into its second position to place stop surface 44*c* in position for engagement by second tooth element 48*b*. In this intermediate pivotal position of ratchet pawl 48, the distance between gauging element 36*a* and gauging surface 26*d'*, although greater than that depicted in FIGS. 3*a* and 3*c*, still remains less than the given coin diameter in order to permit the gauging element and the gauging surface to cooperate for purposes of edge supporting a given diameter coin at the sensing station for detection by finger 32*a* in the manner previously described.

Operation of a lock unit modified in accordance with the teachings of the present invention will now be described, while first assuming that the patron lock 18 is initially disposed in its unlocked condition for purposes of maintaining lever 36 in its coin gauging position, as shown in FIG. 1, that coin counting wheel 44 is in its first rotatable position and that ratchet pawl 48 is in its first pivotal position shown in FIG. 3*a*. A patron initiates operation of lock unit 10 after placing his valuables in a storage compartment "C" with which such lock unit is associated by closing its door "D" to effect depression of rod 20 and free patron lock 18 for subsequent operation upon the deposit of a preselected number of coins of a given diameter or denomination specified by printed instructions appearing on locker cabinet "L". In the illustrated construction, the deposit of seven U.S. quarters is required to permit the operation of the lock unit. Now assuming that a first deposited coin is a U.S. quarter "Q", such coin will engage with gauging element 36*a* and force same from its gauging position shown in FIG. 3*a* thereby to effect pivotal movement of ratchet pawl 48 into its second pivotal position illustrated in FIG. 3*b* for purposes of driving wheel 44 through one step of rotational movement towards its second rotational position. Upon continued passage of the quarter downwardly through coin chute 26, it will pass out of engagement with engaging element 36*a* thereby to permit spring 54 to return ratchet pawl 48 to its first pivotal position incident to which wheel 44 is driven through a second unit of rotation to complete a first counting cycle of rotational movement, as indicated in FIG. 3*c*. An additional counting cycle will occur each time an additional quarter is deposited in coin chute 26; it being understood that no counting cycle occurs when coins of like currency, but of smaller diameter, namely, dimes, nickles and pennies, are deposited in coin chute 26 since their diameter is less than the distance between coin gauging surface 26*d'* and gauging element 36*a* for all positions thereof, including its gauging position shown in FIGS. 3*a* and 3*c*.

Coincident to the passage of a last deposited quarter of the preselected number of coins through the coin chute 26, second tooth element 48*b* engages with stop surface 44*c* so as to arrest ratchet pawl 48 in its intermediate pivotal position shown in FIG. 3*d*, wherein gauging element 36*a* is positioned to cooperate with gauging surface 26*d'* to support such last deposited quarter at the sensing station in the manner depicted in FIG. 3*d*. The positioning of the last deposited quarter in the sensing station is then sensed by coin feeling finger 32*a* for purposes of freeing patron lock 18 for movement into its locked condition shown in FIG. 2 under the control of the patron key. As an incident to movement of patron lock 18 towards its locked condition, plate 18*c* is rotated in a counterclockwise direction, as seen in FIGS. 1 and 2, which first results in the tensioning of reset chain 52 and then the subsequent "pulling" of wheel 44 for return to its first rotatable position in the manner generally depicted in FIG. 3*e*. In the illustrated construction, cam surface 18*d* is moved into alignment with lever following finger 36*c* incident to the completion of movement of patron lock 18 into its fully locked condition, whereby to free lever 36 for pivotal movement into its release position shown in FIGS. 2 and 3*e* under the bias of the weight of the last deposited quarter; such movement of lever 36 permitting displacement of gauging element 36*a* into or beyond its normal release position in order to permit discharge of such last deposited quarter from the sensing station. A cycle of lock unit operation is completed upon return of patron lock 18 to its unlocked condition under the control of a patron key; the resultant clockwise directed rotational movement of plate 18*c* removing cam surface 18*d* from engagement with follower finger 36*c*, so as to cause lever 36 to return to its initial or coin gauging position.

Reference is now made to FIG. 5 wherein is illustrated an alternative form of the present coin counting and release mechanism 40'; wherein parts corresponding to those of mechanism 40 are designated by like primed numerals. Mechanism 40' departs principally from mechanism 40 in the provision of means for adjustably varying the preselected number of coins required to operate a lock unit. In the presently preferred construction of mechanism 40', the means for effecting adjustment comprises a generally L-shaped adjustment or stop plate 60 having a main plate portion 60*a*, which is provided with an aperture 60*b* sized to rotatably receive bearing pin 46'; and a stop plate portion 60*c*, which is preferably provided with a detent or dimple 60*d* arranged to project into the recesses bounded by adjacent pairs of teeth 44*b'*. Main plate portion 60*a* is normally biased into frictional engagement with the side planar surface of wheel 44' by one or more coils 54*a* of spring 54', which are wound around bearing pin 46' intermediate the main plate portion and a spring clip or retainer 62. In the adjusted position of plate 60 shown in FIG. 5, mechanism 40' adapts an associated lock unit for operation by four coins. As by way of example, mechanism 40' may be adjusted to provide for three coin operation by manually moving plate 60 axially of bearing pin 46' against the bias of coils 54*a* sufficiently to remove detent 60*d* from between the third and fourth teeth, rotating the plate in a counterclockwise direction sufficiently to align the detent with the space between the second and third teeth and finally allowing spring coils 54*a* to return main plate portion 60*a* to its original position in engagement with wheel 44. Alternatively, adjustment mechanism 40' may be rendered inoperative and wheel 44' returned to its full or seven coin capacity condition by manipulating plate 60 to position detent 60*d* in overlying engagement with stop surface 44*c'*.

While the coin counting and release mechanism of the present invention has been described with particular reference to its use in retrofitting previously installed lock units of the type described in U.S. Pat. Nos. 3,193,074; 3,228,506 and 3,599,770 for purposes of converting same for multiple coin operation, it will be appreciated that the invention is equally adapted for use in new lock unit constructions, whether or not same have identity of design to that of such prior patents. Thus, it is contemplated that the present invention in its broadest sense possesses utility in providing for multiple coin operation of any lock unit having a patron lock movable between unlocked and locked conditions upon the sensing of a coin of a given diameter retained in a sensing station, wherein the present mechanism may be associated with a suitable gauging surface to define means having coin gauging and release conditions corresponding to the unlocked and locked condition of the patron lock; such means when in its gauging condition counting the number of coins of such given diameter deposited in the lock unit and retaining in the sensing station only the last deposited coin of a preselected number of coins of such given diameter, while permitting passage downwardly through the sensing station of all previously deposited coins of such given diameter or of a smaller diameter of a like currency, and such means when in its release condition releasing the last deposited coin for discharge from the sensing station.

I claim:

1. A multiple coin operated lock unit adapted for operation by a preselected number of coins of a given diameter and having a coin chute, a patron lock movable between unlocked and locked conditions upon sensing of a coin of said given diameter retained at a sensing station within said coin chute, a gauging surface adjacent said sensing station and retaining means adjacent said gauging surface and having coin gauging and release conditions corresponding to said unlocked and locked conditions of said patron lock, said retaining means when in said gauging condition cooperating with said gauging surface to count the number of coins of said given diameter deposited in said coin chute for passage through said sensing station and to retain only a last deposited coin of said preselected number of coins of said given diameter in said sensing station, while permitting passage downwardly therebetween and through said sensing station of all previously deposited coins of said given diameter or of a smaller diameter of a like currency, and said retaining means when in said release condition releasing said last deposited coin for movement from said sensing station.

2. A lock unit according to claim 1, wherein said retaining means includes a lever supported for movement under the control of said patron lock between coin gauging and release positions corresponding to said unlocked and locked conditions, and a coin gauging and counting means carried by said lever and cooperating with said gauging surface, when said lever is in said gauging position, to count the number of said coins of given diameter deposited in said coin chute and to retain in said sensing station said last deposited coin, while permitting passage downwardly through said coin chute of all said previously deposited coins, and for permitting discharge of said last deposited coin from said sensing station upon movement of said lever into said release position.

3. A lock unit according to claim 2, wherein said coin gauging and counting means is adjustable to vary said preselected number of coins.

4. A lock unit according to claim 1, wherein said retaining means includes a lever supported for movement under the control of said patron lock between coin gauging and release positions; and coin gauging and counting means, said coin gauging and counting means including a wheel rotatably supported on said lever and having first and second groups of ratchet teeth extending radially thereof and annularly separated by a stop means, said wheel having first and second rotatable positions, reset means under the control of said patron lock for positioning said wheel in said first rotatable position to initiate a coing gauging and counting operation; a ratchet pawl pivotally mounted on said lever for movement between first and second pivotal positions, said ratchet pawl having first and second tooth elements and a coing gauging element, and a bias tending to maintain said ratchet pawl in said first pivotal position, wherein said first tooth element engages and said second tooth element is removed from engagement with the ratchet teeth of said first and second groups, respectively, characterized in that, while said lever is in said coin gauging position, said gauging element is placed in a gauging position spaced from said gauging surface through a distance less than said given diameter and greater than said smaller diameter when said ratchet pawl is in said first pivotal position, passage of a coin of said given diameter downwardly through said coin chute tends to move said gauging element away from said gauging surface and pivot said ratchet pawl against said bias into said second pivotal position, wherein said first tooth element is removed from engagement and said second tooth element is moved for engagement with said ratchet teeth of said first and second groups and said gauging element assumes a release position spaced from said gauging surface through a distance greater than said given diameter to free said coin of said given diameter for continued passage downwardly through said coin chute and permit return of said ratchet pawl to said first pivotal position, wherein movement of said ratchet pawl from said first pivotal position into said second pivotal position against said bias and return of said ratchet pawl from said second pivotal position to said first pivotal position under said bias completes a single coin counting cycle of pivotal movement of said ratchet pawl during which in succession said second tooth element engages with said ratchet teeth of said second group and first tooth element engages with said ratchet teeth of said group to drive said wheel in a stepwise manner through a single coin counting cycle of rotational movement in a direction towards said second rotatable position, said second rotatable position of said wheel being determined by engagement of said second tooth element with said stop means coincident to which said gauging element is constrained against movement into said release position thereof and cooperates with said gauging surface to retain said last deposited coin in said sensing station, until movement of said lever into said release position thereof.

5. A lock unit according to claim 4, wherein adjustment means are carried by said wheel for varying the placement of said stop means whereby to determine the number of coin counting cycles of rotational movement of said wheel.

6. A lock unit according to claim 5, wherein said reset means is a tension member having opposite ends affixed to said wheel and said patron lock.

7. A multiple coin operated lock unit adapted for operation by a preselected number of coins of a given diameter deposited therein and having a patron lock movable between unlocked and locked conditions upon sensing of a coin of said given diameter retained in a sensing station within said lock unit; a gauging surface adjacent said sensing station; and retaining means having coin gauging and release conditions corresponding to said unlocked and locked conditions of said patron lock, said retaining means when in said gauging condition cooperating with said gauging surface to count the number of coins of said given diameter deposited in said lock unit for passage through said sensing station and to retain only a last deposited coin of said preselected number of coins of said given diameter in said sensing station, while permitting passage downwardly therebetween and through said sensing station of all previously deposited coins of said given diameter or of a smaller diameter of a like currency, said retaining means when in said release condition releasing said last deposited coin for movement from said sensing station, and said retaining means is adjustable to vary said preselected number of coins.

8. In a coin operated lock unit having a coin chute, a patron lock movable between unlocked and locked conditions, constraining means normally constraining said patron lock from movement from said unlocked position, coin sensing means responsive to a coin of a given diameter retained in a sensing station within said coin chute to render said constraining means inoperative to permit movement of said patron lock into said locked condition, a gauging surface and retaining means cooperating with said gauging surface for releasably retaining a coin of said given diameter in said sensing station, the improvement for adapting said lock unit for operation by a preselected number of coins of said given diameter, wherein said retaining means comprises in combination:

a lever supported for movement under the control of said patron lock between coin gauging and release positions; and a coin gauging and counting means carried by said lever and cooperating with said gauging surface, when said lever is in said coin gauging position, to count the number of coins of said given diameter deposited in said coin chute and to retain in said sensing station only a last deposited coin of said preselected number of coins of said given diameter, while permitting passage downwardly through said coin chute of all previously deposited coins of said given diameter or of a smaller diameter of a like currency, and for permitting discharge of said last deposited coin from said sensing station upon movement of said lever into said release position.

9. The improvement according to claim 8, wherein said coin gauging and counting means is adjustable to vary said preselected number of coins.

10. The improvement according to claim 8, wherein said coin gauging and counting means includes a coin counting means having a first position and a second position, and coin gauging means responsive to passage of coins of said given diameter through said coin chute for controlling movement of said counting means in a stepwise manner from said first position into said second position, wherein said counting means cooperates with said gauging means to maintain said last deposited coin in said sensing station, and reset means for returning said counting means to said first position thereof to initiate a coing gauging and counting operation.

11. The improvement according to claim 10, wherein said counting means is a wheel rotatably supported by said lever for movement between said first and second positions thereof.

12. The improvement according to claim 10, wherein said gauging means is a pawl pivotally supported by said lever for movement between first and second pivotal positions incident to the passage of a coin of said given diameter downwardly through said coin chute for moving said counting means in a stepwise manner between said firsrt and second positions thereof.

13. The improvement according to claim 12, wherein said counting means is a wheel rotatably supported by said lever for movement between said first and second positions thereof.

14. The improvement according to claim 13, wherein said counting means is adjustable to vary said preselected number of coins required to operate said lock unit.

15. The improvement according to claim 8, wherein said coing gauging and counting means includes a coin counting wheel having first and second rotatable positions, reset means under the control of said patron lock for positioning said wheel in said first rotatable position to initiate a coin gauging and counting operation, and coin gauging means responsive to passage of coins of said given diameter through said coin chute for controlling the movement of said wheel in a stepwise manner from said first rotatable position into said second rotatable position, wherein said wheel cooperates with said gauging means to maintain said last deposited coin in said sensing station, and adjustment means is carried by said wheel for controlling said second rotatable position thereof, thereby to vary said preselected number of coins required to operate said lock unit.

16. The improvement according to claim 8, wherein said coin gauging and counting means includes a wheel rotatably supported on said lever and having first and second groups of ratchet teeth extending radially thereof and annularly separated by a stop means, said wheel having first and second rotatable positions, reset means under the control of said patron lock for positioning said wheel in said first rotatable position to initiate a coin gauging and counting operation, a ratchet pawl pivotally mounted on said lever for movement between first and second pivotal positions, said ratchet pawl having first and second tooth elements and a coin gauging element, and a bias, said bias tending to maintain said ratchet pawl in said first pivotal position, wherein said first tooth element engages and said second tooth element is removed from engagement with the ratchet teeth of said first and second groups, respectively, and to oppose movement of said ratchet pawl into said second pivotal position, wherein said first tooth element is removed from engagement and said second tooth element is moved for engagement with said ratchet teeth of said first and second groups, respectively, characterized in that, when said lever is in said coin gauging position, placement of said ratchet pawl in said first pivotal position arranges said gauging element in a gauging position spaced from said gauging surface through a distance less than said given diameter and greater than said smaller diameter, passage of a coin of said given diameter downwardly through said coin chute tends to move said ratchet pawl into said second pivotal position, wherein said gauging element is arranged in a release position spaced from said gauging surface through a distance greater than said given diameter to free said coin of said given diameter for continued passage downwardly through said coin chute and permit return of said ratchet pawl to said first pivotal position, movement of said ratchet pawl from said first pivotal position into said second pivotal position against said bias and return of said ratchet pawl from said second pivotal position to said first pivotal position under said bias completing a single coin counting cycle of pivotal movement of said ratchet pawl during which in succession said second tooth element engages with said ratchet teeth of said second group and said first tooth element engages with said said ratchet teeth of said first group to drive said wheel in a stepwise manner through a single coin counting cycle of rotational movement in a direction towards said second rotatable position, said second rotatable position of said wheel being determined by engagement of said second tooth element with said stop means coincident to which said gauging element is constrained against movement into said release position thereof and cooperates with said gauging surface to retain said last deposited coin in said sensing station, until movement of said lever into said release position thereof.

17. The improvement according to claim 16, wherein adjustment means are carried by said wheel for varying the placement of said stop means, whereby to determine the number of counting cycles of rotational movement of said wheel.

18. The improvement according to claim 17, wherein said resetting means is a tension member having opposite ends affixed to said wheel and said patron lock.

* * * * *